US007375694B2

(12) United States Patent
Jung et al.

(10) Patent No.: US 7,375,694 B2
(45) Date of Patent: May 20, 2008

(54) ANTENNA CAPABLE OF MICRO-TUNING AND MACRO TUNING FOR WIRELESS TERMINAL

(75) Inventors: Chang-won Jung, Yongin-sin (KR); Yong-jin Kim, Yongin-si (KR); Yong-eil Kim, Yongin-si (KR); Se-hyun Park, Yongin-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 11/606,146

(22) Filed: Nov. 30, 2006

(65) Prior Publication Data

US 2008/0001823 A1 Jan. 3, 2008

(30) Foreign Application Priority Data

Jul. 3, 2006 (KR) ..... 10-2006-0062027

(51) Int. Cl.
*H01Q 9/00* (2006.01)
*H01Q 1/38* (2006.01)

(52) U.S. Cl. ..... 343/745; 343/700 MS; 343/702

(58) Field of Classification Search ..... 343/745, 343/749, 750, 700 MS, 702
See application file for complete search history.

(56) References Cited

U.S. PATENT DOCUMENTS 7,071,887 B2 * 7/2006 Shigihara et al. ..... 343/744
7,129,894 B1 * 10/2006 Winter ..... 343/700 MS
7,260,424 B2 * 8/2007 Schmidt ..... 455/575.7
7,307,598 B2 * 12/2007 Shigihara ..... 343/788
7,315,287 B2 * 1/2008 Shigihara ..... 343/744
2006/0262015 A1 * 11/2006 Thornell-Pers et al. ..... 343/702

FOREIGN PATENT DOCUMENTS

KR 1998-087437 A 12/1998
KR 20-0393219 Y1 8/2005
KR 2006-0012621 A 2/2006
WO 2004102737 A1 11/2004

* cited by examiner

*Primary Examiner*—Hoang V Nguyen
(74) *Attorney, Agent, or Firm*—Sughrue Mion, PLLC

(57) ABSTRACT

Disclosed is an antenna capable of micro-tuning and macro-tuning for a wireless terminal, comprising: a radiator radiating electromagnetic waves; a ground connected to the radiator; at least one switching element positioned at a lengthwise region of the radiator, for shorting or opening the region of the radiator; and a voltage controlling element positioned at the radiator between the switching element and the ground, for controlling the extent of a voltage potential applied across the radiator. In accordance with the present invention, the antenna is capable of the macro-tuning between the service bands and micro-tuning for channel control within the service bands. Furthermore, the size of the antenna is significantly reduced and the antenna is installed on a circuit board in a patch type, thereby simplifying a work process.

11 Claims, 6 Drawing Sheets

ANTENNA CAPABLE OF MICRO-TUNING AND MACRO TUNING FOR WIRELESS TERMINAL

CROSS-REFERENCE TO RELATED APPLICATIONS

This application claims priority from Korean Patent Application No. 10-2006-0062027, filed Jul. 3, 2006, in the Korean Intellectual Property Office, the entire contents of which are incorporated herein by reference.

BACKGROUND OF THE INVENTION

1. Field of the Invention

The present invention relates to an antenna capable of micro tuning and macro tuning for a wireless terminal, and more particularly, to an antenna capable of micro tuning and macro tuning for a wireless terminal, which is capable of control in a dual service band having a difference of a certain or higher frequency, and which is capable of frequency tuning between channels in each service band.

2. Description of the Related Art

As wireless communication has been developed, wireless network can be accessed by wireless terminals, such as personal computers, notebooks, mobile phones, PDA and so on. The technology for supporting the wireless access to network in real time in mobile working environment is called wireless local-area network (WLAN).

According to the WLAN standards of IEEE 802.11, in IEEE 802.11b, wireless signals are transmitted and received through the 2.4 GHz frequency band which is the industrial, scientific and medical (ISM) band, and in IEEE 802.11a, wireless signals are transmitted and received through the 5 GHz frequency band which is the unlicensed national information infrastructure (UNII) band.

In the 2.4 GHz, which is the frequency band for IEEE 802.11b, transmission at the bandwidth of 83.5 MHz, from 2.4 GHz to 2.4835 GHz, is permitted. In the 5 GHz, which is the frequency band for IEEE 802.11a, transmission at the bandwidth of a total of 300 MHz, from 5.15 GHz to 5.35 GHz and from 5.725 GHz to 5.825 GHz, is permitted.

The WLAN service has a different frequency band according to the standards utilized. Consequently, the standards may change at any time or in different localities. In this case, since an existing wireless terminal is manufactured so as to process signals within the frequency band according to one standard only, a user may need to purchase another terminal for a new standard. To prevent such waste, a wireless terminal which functions in different standards needs to be developed.

In order to operate a wireless terminal in the frequency bands of both standards, an antenna has to operate in both frequency bands. For this purpose, a wireless terminal is provided with an antenna operating in both frequency bands. That is, an antenna having a very broad frequency band may be installed to operate in the frequency band of 2.4 GHz to 5 GHz, or an antenna having a dual frequency band may be installed to separately operate in the frequency band of 2.4 GHz and in the frequency band of 5 GHz.

However, when using the antenna operating in the very broad frequency band of 2.4 GHz to 5 GHz, noise and interference occur in a non-use band.

Due to the aforementioned problem, antenna developing industries have developed an antenna separately operating in each of the 2.4~2.5 GHz and 4.9~5.9 GHz frequencies. However, this antenna has not yet been sufficiently small in size. When using the antenna separately operating in the both frequency bands, tuning performance between channels in each frequency band is not taken into consideration.

SUMMARY

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides an antenna capable of micro-tuning and macro-tuning for a wireless terminal, which is capable of control between the dual service band having a difference of a certain or higher frequency and which is capable of frequency tuning between channels in each service band.

Also, the present invention provides an antenna capable of micro-tuning and macro-tuning for a wireless terminal, which is small in size.

According to an aspect of the present invention, there is provided an antenna capable of micro-tuning and macro-tuning for a wireless terminal, comprising: a radiator radiating electromagnetic waves; a ground connected to the radiator; at least one switching element positioned at a lengthwise region of the radiator, for shorting or opening the region of the radiator; and a voltage controlling element positioned at the radiator between the switching element and the ground, for controlling the extent of a voltage potential across the radiator.

Preferably, the radiator may comprise a meander line part being severally bent in zigzags.

Preferably, the switching element may be a PIN diode.

Preferably, the antenna may further comprise a switching controller for applying a certain or higher voltage to the switching element to be turned on.

Preferably, upon turning on the switching element, the radiator may operate in a lower frequency band than upon turning off the switching element, and upon turning off the switching element, the radiator may operate in a higher frequency band than upon turning on the switching element.

Preferably, a plurality of the switching elements may be positioned, at a predetermined distance, along the direction of the length of the radiator.

Preferably, the voltage-controlling element may be a varactor diode.

The antenna may further comprise a reverse voltage adjuster for supplying a reverse voltage to the voltage-controlling element.

The operation frequency may be controlled within a predetermined frequency bandwidth, according to the extent of the reverse voltage applied to the voltage-controlling element.

The operation frequency may increase within the predetermined frequency bandwidth as the extent of the reverse voltage applied to the voltage controlling element increases.

According to the extent of the reverse voltage applied to the voltage-controlling element, upon turning on the switching element, the operation frequency may be controlled within a predetermined frequency bandwidth included in a lower frequency band than upon turning off the switching element, and upon turning off the switching element, the operation frequency may be controlled within a predetermined frequency bandwidth included in a higher frequency band than upon turning on the switching element.

BRIEF DESCRIPTION OF THE DRAWINGS

The above and/or other aspects of the present invention will become more apparent by describing in detail exemplary embodiments thereof with reference to the attached drawing figures, wherein;

FIG. 4A is a graph illustrating a resonance point of an antenna when a PIN diode is turned on;

DETAILED DESCRIPTION

Hereinafter, exemplary embodiments of the present invention will be described in detail with reference to the accompanying drawing figures.

Figure 1:
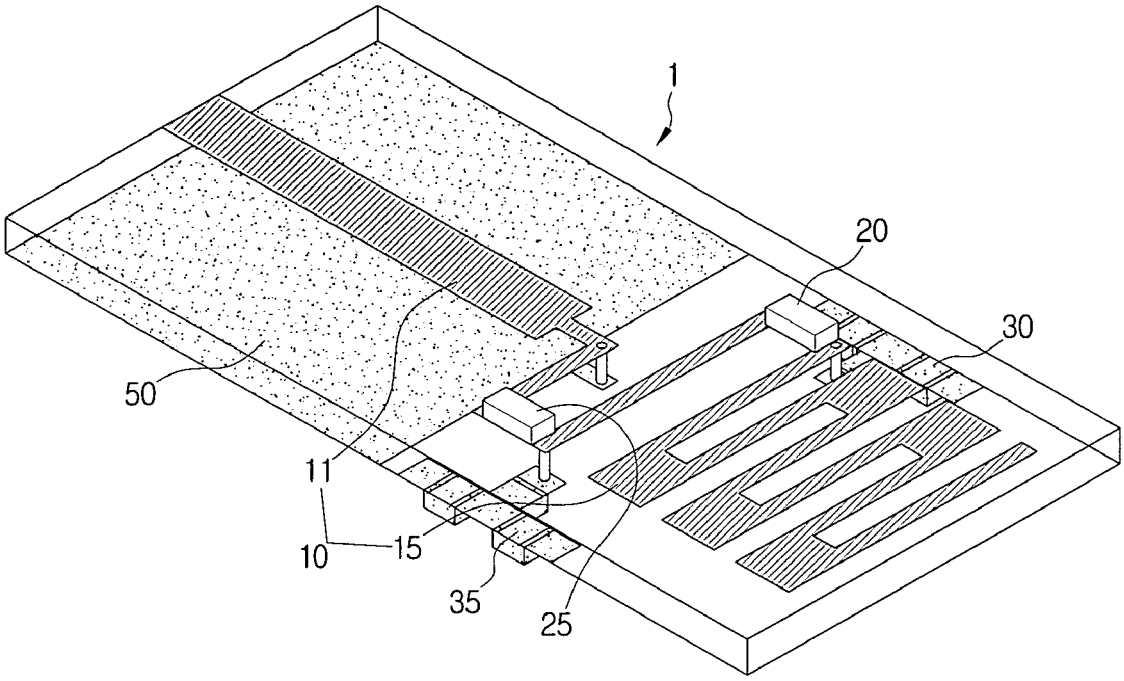
FIG. 1 is a perspective view illustrating an antenna for a wireless terminal, in accordance with an embodiment of the present invention.
Figure 2:
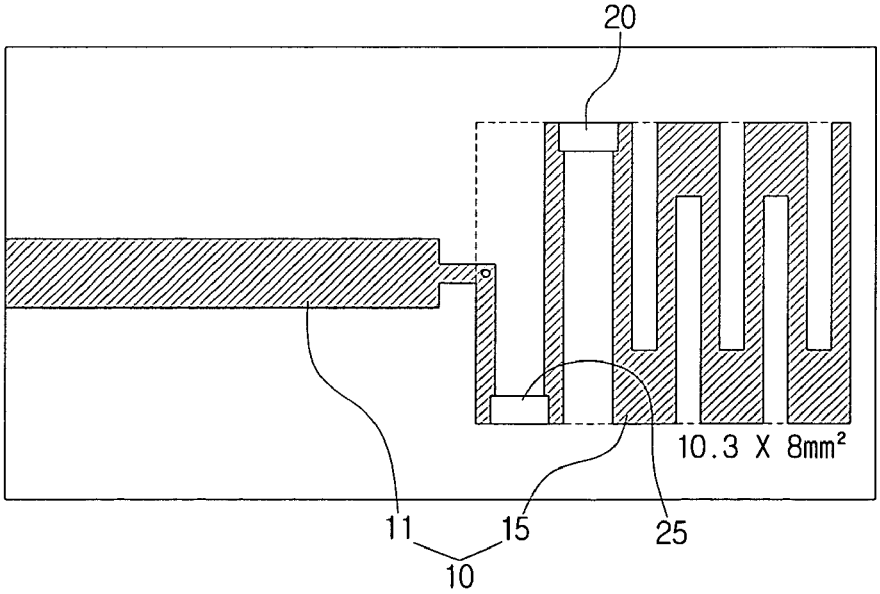
FIG. 2 is a front view illustrating the antenna of FIG. 1.
Figure 3:
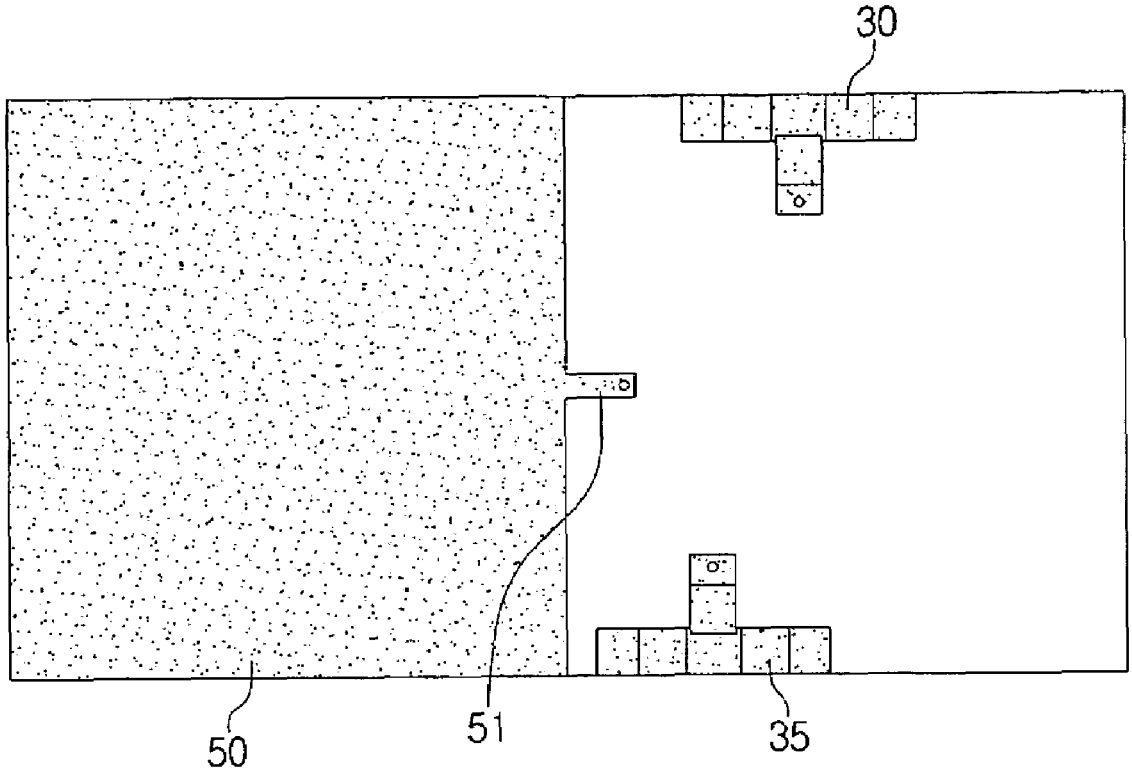
FIG. 3 is a bottom view illustrating the antenna of FIG. 1.

FIG. 1 is a perspective view illustrating an antenna 1 for a wireless terminal, in accordance with an embodiment of the present invention; FIG. 2 is a front view illustrating the antenna of FIG. 1; and FIG. 3 is a bottom view illustrating the antenna of FIG. 1.

The antenna 1 for a wireless terminal comprises a radiator 10, a ground conductor 50, a PIN diode 20, a varactor diode 25, a switching controller 30, and a reverse voltage adjuster 35.

The ground conductor 50 is attached to or formed onto one surface of a circuit board and is electrically connected to the radiator 10. For this purpose, a protrusion 51 protruding from the ground 50 is formed at one side of the ground 50. The protrusion 51 is electrically connected to one side of the radiator 10 through a via or contact hole.

The radiator 10 is attached to or formed onto the other surface of the circuit board in a patch antenna type. The radiator 10 includes a meander line part 15 being severally bent lengthwise, and a feeding part 11 being formed in a linear band shape. The length of the feeding part 11 is almost same as that of the ground 50. The feeding part 11 is positioned to correspond to the region where the ground 50 is formed.

The meander line part 15 is extended, at a predetermined length, from an end of the feeding part 11 and is severally bent in zigzags. An end region of the meander line part 15 towards the feeding part 11 is electrically connected to the ground 50 through a via hole.

The size of the antenna 1 is significantly reduced compared with the conventional antenna since the radiator 10 is formed in the meander line. A conventional antenna has a length from a several tens of millimeters to several hundreds of millimeters. However, the antenna 1 of the present invention is formed to be 10.3×8 $mm^2$ in size. The manufacturing of antenna 1 is relatively simple since the radiator 10 is positioned on the circuit board as a patch type antenna.

The PIN diode 20 is positioned at one side region, along the direction of the length of the meander line part 15. The PIN diode 20 electrically shorts or opens the meander line connected to both ends of the PIN diode 20.

Figure 4A:
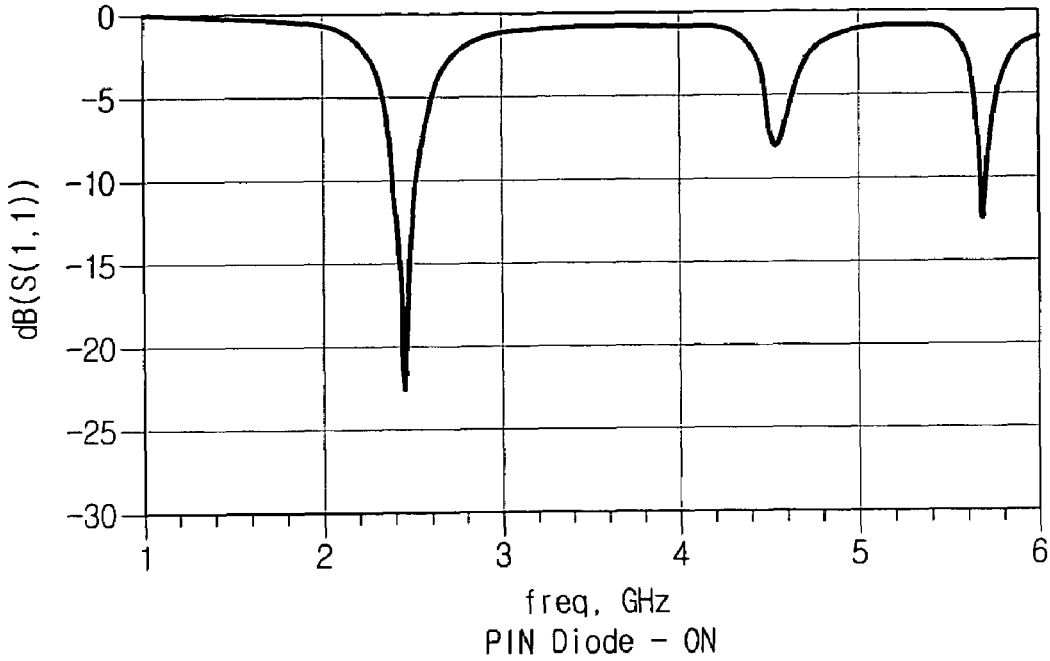

Generally, when a certain prescribed or higher voltage is applied, the PIN diode 20 is turned on. In accordance with the embodiment of the present invention, when a voltage of 5V or higher is applied, an intrinsic series resistance is 1Ω, and the PIN diode 20 is turned on. Accordingly, the meander line connected by the PIN diode 20 shorts, resulting in the length of the radiator 10 being the total length which is derived by adding the length of the feeding part 11 to the length of the meander line part 15. In the embodiment of the present invention, the total length of the radiator 10 is 56.5 mm, and the antenna 1 has a resonance point in the frequency band of 2.4 GHz, as illustrated in FIG. 4A. The bandwidth of the antenna 1 in the frequency band of 2.4 GHz is 150 MHz based on −10 dB. Since the bandwidth of 150 MHz is expanded, compared to the common bandwidth of 80 MHz, it may be understood that the performance of the antenna 1 is improved.

Figure 4B:
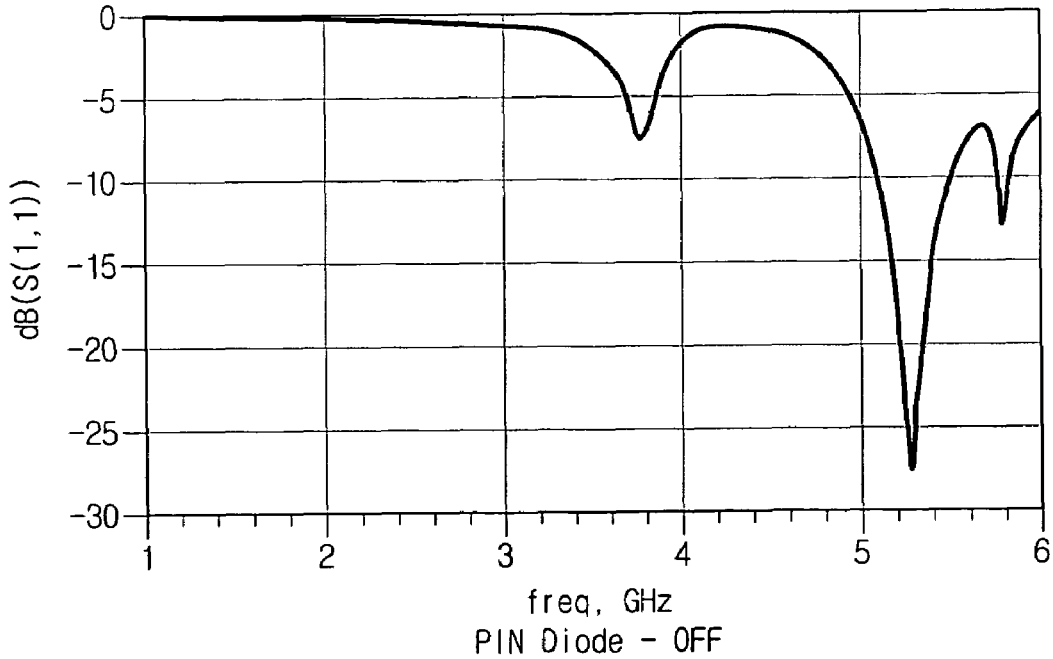
FIG. 4B is a graph illustrating a resonance point of an antenna when the PIN diode is turned off.

When no voltage is applied to the PIN diode 20, the series resistance is 10 kΩ, and the PIN diode 20 is turned off. Accordingly, the meander line connected by the PIN diode 20 opens, and the length of the radiator 10 is a value which is derived by adding the length of the feeding part 11 to the length of the portion of the meander line part 15 up to the PIN diode 20. Then, the length of the radiator 10 is 14.65 mm, and the antenna 1 resonates at, or has the resonance point of 5.3 GHz, as illustrated in FIG. 4B. In this case, the bandwidth of the antenna 1 in the frequency band of 5.3 GHz is 400 MHz based on −10 dB.

That is, when the PIN diode 20 is turned on and the length of the radiator 10 is its full length, the antenna 1 has the resonance point of 2.4 GHz. When the PIN diode 20 is turned off and the length of the radiator 10 is shortened, the antenna 1 has the resonance point of 5.3 GHz.

Accordingly, the antenna 1 is capable of selectively changing frequency between the 2.4 GHz frequency band for IEEE 802.11b and the 5.3 GHz frequency band for IEEE 802.11a by the PIN diode 20. That is, the antenna 1 is capable of macro tuning. In the above-described embodiment, the length of the radiator 10 is designed to form appropriate operation frequency for the WLAN band. However, the operation frequency band may be changed by changing the length of the radiator 10. Further, since the voltage of 5V applied when the PIN diode 20 is turned on is generally used for a wireless terminal, any additionally voltage supply source is not required, thereby reducing costs and simply constituting a circuit.

The varactor diode 25 is positioned at the meander line part 15 between the feeding part 11 and the PIN diode 20. According to the extent of a reverse voltage applied to the varactor diode 25, the frequency of the antenna 1 changes between channels within the service band. A reverse voltage which continuously changes within the range of 0~3V is applied to the varactor diode 25. Before a reverse voltage bias is applied, a depletion region of the varactor diode 25 is smallest, so as to have highest capacitance. The antenna 1 has the resonance point in a channel with the lowest frequency within the 2.4 GHz frequency band or the 5.3 GHz frequency band.

When the reverse voltage is applied to the varactor diode 25, the depletion region increases and thus the capacitance decreases. Then, the resonance point of the antenna 1 moves to a channel with the highest frequency within the service band. That is, as the reverse voltage increases, the varactor diode 25 moves the resonance point of the antenna 1 to the channel with the highest frequency. Thus, the antenna 1 is capable of changing the channels within the service band by controlling the reverse voltage applied to the varactor diode 25. That is, the antenna 1 is capable of micro-tuning.

Figure 5A:
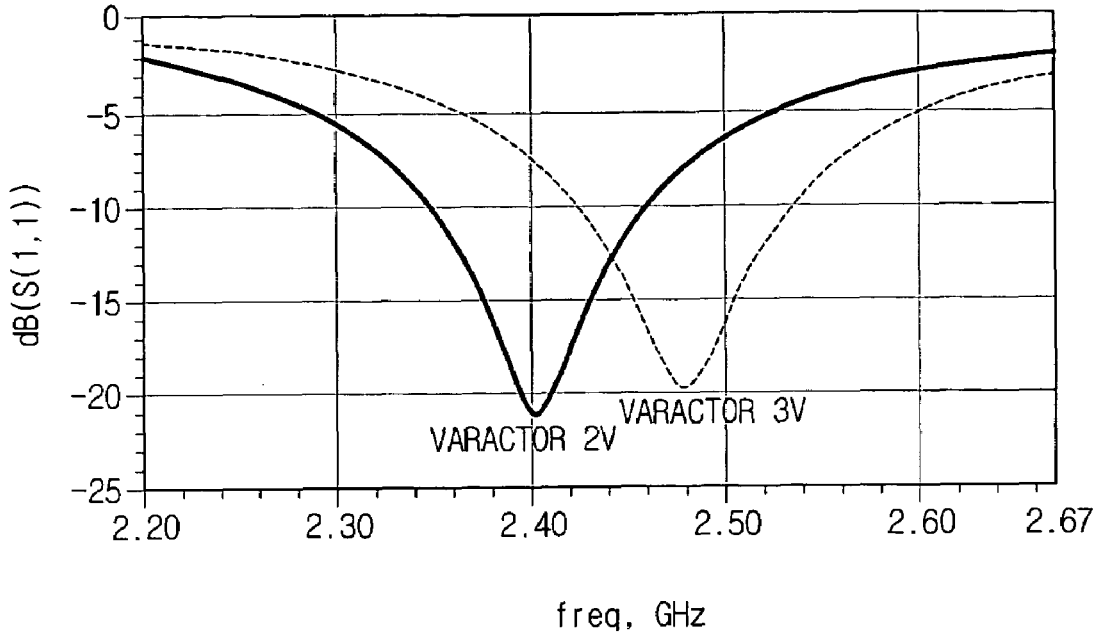
FIG. 5A is a graph illustrating a result of micro-tuning by a varactor diode in the 2.4 GHz frequency band.
Figure 5B:
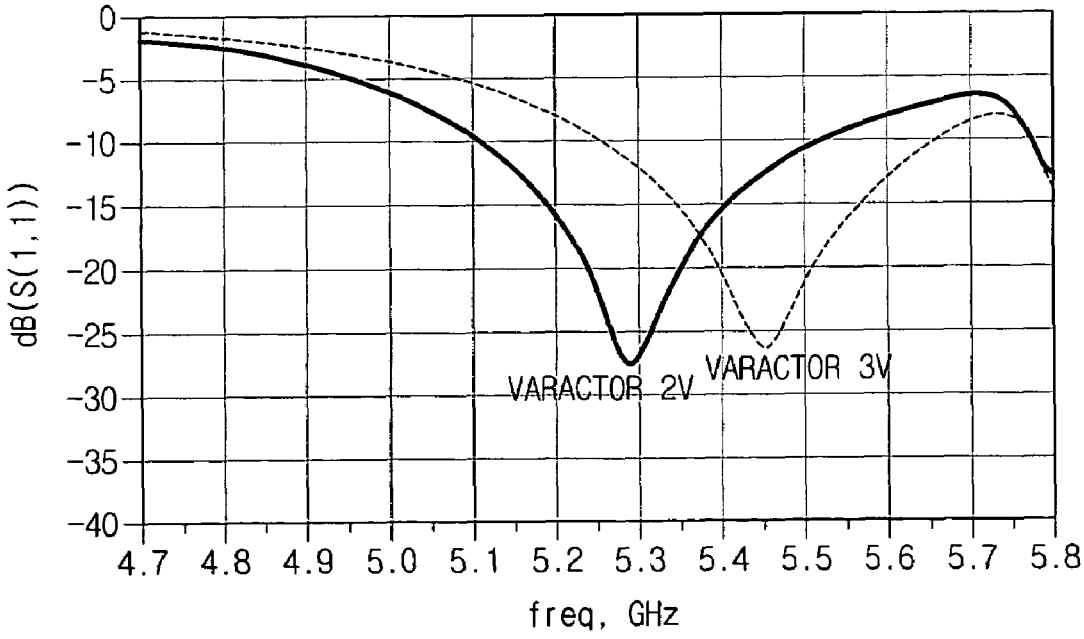
FIG. 5B is a graph illustrating a result of micro-tuning by a varactor diode in the 5 GHz frequency band.

FIG. 5A is a graph illustrating a result of micro-tuning by the varactor diode 25 in the 2.4 GHz frequency band, and FIG. 5B is a graph illustrating a result of micro-tuning by the varactor diode 25 in the 5 GHz frequency band.

When the PIN diode 20 is turned on, the meander line shorts, so that the resonance point is formed in the 2.4 GHz frequency band. In such a state, the micro-tuning of the resonance point is performed by controlling the reverse voltage applied to the varactor diode 25. As illustrated in FIG. 5A, when the reverse voltage of 2V is applied to the varactor diode 25, the resonance point is formed at 2.4 GHz, and when the reverse voltage of 3V is applied to the varactor diode 25, the resonance point is formed at 2.48 GHz. $S_{11}$ at 2.4 GHz is −21 dB, and $S_{11}$ at 2.48 GHz is −20 dB. A resonance point between 2.4 GHz and 2.48 GHz may be formed by applying the reverse voltage of 2V~3V to the varactor diode 25.

As illustrated in FIG. 5B, when the reverse voltage of 2V is applied to the varactor diode 25, the resonance point is formed at 5.3 GHz, and when the reverse voltage of 3V is applied to the varactor diode 25, the resonance point is formed at 5.46 GHz. $S_{11}$ at 5.3 GHz is −27 dB, and $S_{11}$ at 5.46 GHz is −26 dB. A resonance point between 5.3 GHz and 5.46 GHz may be formed by applying the reverse voltage of 2V~3V to the varactor diode 25.

The switching controller 30 and the reverse voltage adjuster 35, which apply the reverse voltage to the PIN diode 20 and the varactor diode 25, are positioned on the surface where the ground 50 is positioned. The switching controller 30 is connected to the PIN diode 20 through the via hole, and the reverse voltage adjuster 35 is connected to the varactor diode 25 through the via hole, as illustrated in FIG. 1.

The switching controller 35 applies a reverse voltage of 0V or 5V to the PIN diode 20 and is formed in a RLC (resistive-inductive-capacitive) circuit. The reverse voltage adjuster 35 continuously provides a reverse voltage of between 0V to 3V to the varactor diode 25 and is formed in a RLC circuit, as illustrated in FIG. 6A.

Figure 6A:
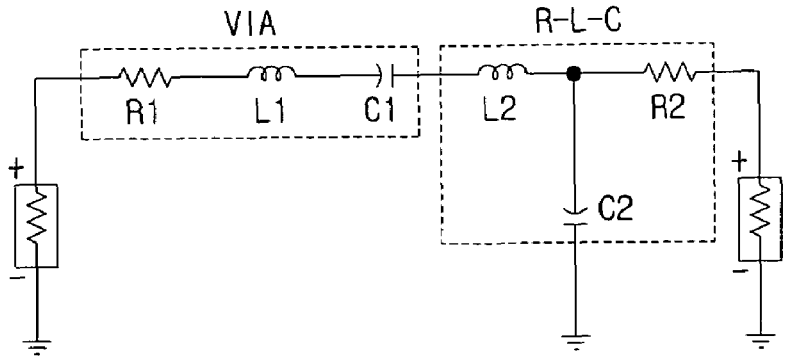
FIG. 6A is a circuit diagram illustrating a via hole and a reverse voltage adjuster.
Figure 6B:
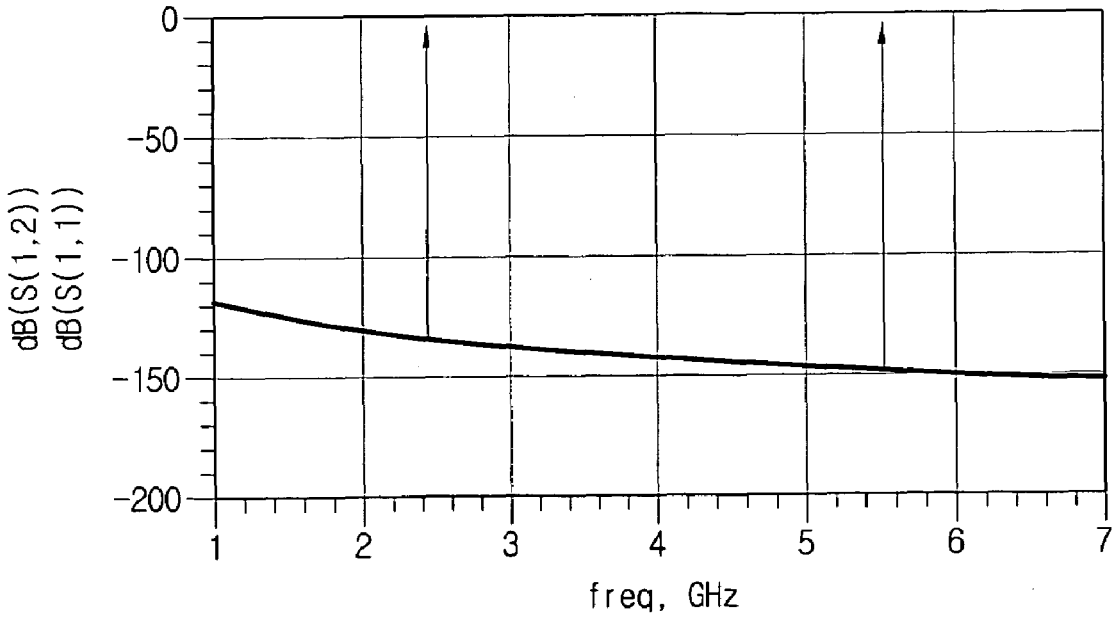
FIG. 6B is a graph illustrating isolation by a via hole and a reverse voltage adjuster.

As illustrated in FIG. 6A, the via hole connecting the varactor diode 25 and the reverse voltage adjuster 35 is indicated as an inductor, and the reverse voltage adjuster 35 includes a resistance, an inductor and a capacitor. The voltage provided by the reverse voltage adjuster 35 should not affect the resonance frequency of the antenna 1, i.e., 2.4 GHz and 5.5 GHz. For this purpose, resistance, inductance and capacitance values are designed to be appropriated. According to such design, as illustrated in FIG. 6B, the via hole and the reverse voltage adjuster 35 form high isolation at 2.4 GHz and 5.5 GHz and overall have $S_{11}$ being less than −100 dB. Since the via hole and the reverse voltage adjuster 35 form the high isolation at 2.4 GHz and 5.5 GHz, these do not affect the antenna 1.

The switching controller 30 is designed based on the same principles for the reverse voltage adjuster 35, and thus it does not affect the antenna 1.

Figure 7A:
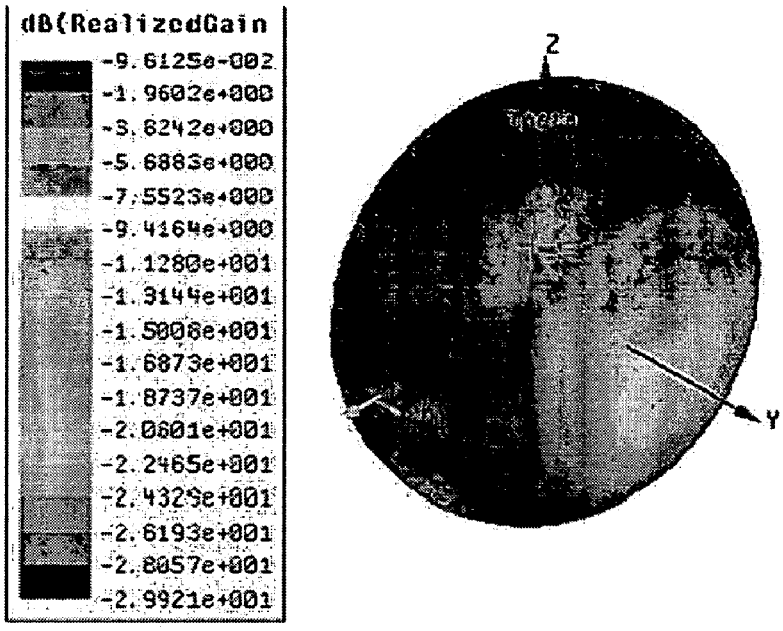
FIG. 7A is a view illustrating a radiation pattern of an antenna when a PIN diode is turned on and a reverse voltage of 2V is applied to a varactor diode.

FIG. 7A illustrates a radiation pattern of the antenna 1 when the PIN diode 20 is turned on and the reverse voltage of 2V is applied to the varactor diode 25.

When the PIN diode 20 is turned on and the reverse voltage of 2V is applied to the varactor diode 25, the resonance point is formed at 2.4 GHz. As illustrated in FIG. 7A, the radiation pattern of the antenna 1 has omni-directionality and a gain is indicated as −0.096 dB.

Figure 7B:
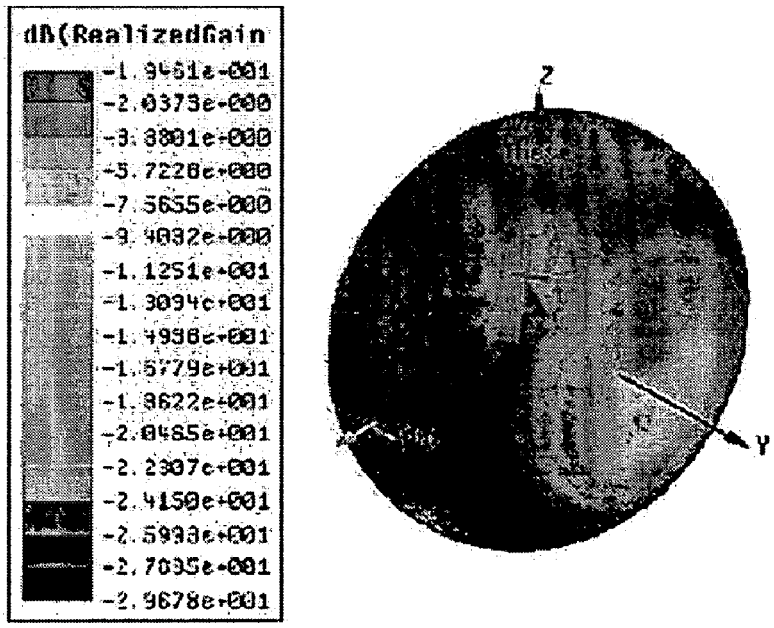
FIG. 7B is a view illustrating a radiation pattern of an antenna when a PIN diode is turned on and a reverse voltage of 3V is applied to a varactor diode.

FIG. 7B illustrates a radiation pattern of the antenna 1 when the PIN diode 20 is turned on and the reverse voltage of 3V is applied to the varactor diode 25.

When the PIN diode 20 is turned on and the reverse voltage of 3V is applied to the varactor diode 25, the resonance point is formed at 2.48 GHz. As illustrated in FIG. 7B, the radiation pattern of the antenna 1 has the omni-directionality and a gain is indicated as −0.194 dB.

Accordingly, since the antenna 1 is omni-directional and the gain is sufficiently excellent, it is usable as a wireless antenna for the WLAN.

As described above, the antenna 1 performs the macro-tuning between the service bands by the PIN diode 20 and the micro-tuning to control the channel frequency within the service band by the varactor diode 25. Accordingly, since it is possible to manufacture an antenna for a wireless terminal receiving signals in the two service bands, which correspond to the two standards of IEEE 802.11, usability is improved and manufacturing cost is reduced.

Furthermore, since the radiator 10 is formed in the form of a meander line, the size of the antenna 1 is significantly reduced compared to that of a conventional antenna, and since the radiator 10 is positioned on the circuit board, it makes it easy to manufacture the antenna 1.

In the above-described embodiment, the antenna is designed to operate in the dual frequency band by placing only one PIN diode 20 on the radiator 10. However, when plurality of the PIN diodes 20 are placed, an antenna may be designed to operate in a plurality of frequency bands.

The results of simulation illustrated in FIGS. 4A, 4B, 5A and 5B are obtained by designing the length of the radiator 10 and controlling the voltage applied to the varactor diode 25, to form appropriate operation frequency for any specific service. Accordingly, the operation frequency band of the antenna 1 may be variously realized by changing the length of the radiator 10 and the voltage applied to the varactor diode 25.

As described above, in accordance with the present invention, the antenna is capable of the macro-tuning between the service bands and the micro-tuning for the channel control within the service bands. Furthermore, the size of the antenna is significantly reduced and the antenna is installed on the circuit board in a patch type, thereby simplifying a manufacturing process.

While the invention has been shown and described with reference to certain exemplary embodiments thereof, it will be understood by those skilled in the art that various changes in form and details may be made therein without departing from the spirit and scope of the invention as defined by the appended claims. For example, the use of the term ground herein may refer to any reference potential and not necessarily earth ground.

What is claimed is:

1. An antenna capable of micro-tuning and macro-tuning for a wireless terminal, comprising:

a radiator radiating electromagnetic waves;

a ground conductor connected to the radiator;

at least one switching element positioned at a lengthwise region of the radiator, for shorting or opening the region of the radiator; and a voltage controlling element positioned at the radiator between the switching element and the ground, for controlling the extent of a voltage potential applied across the radiator.

2. The antenna as claimed in claim 1, wherein the radiator comprises a meander line part being severally bent in zigzags.

3. The antenna as claimed in claim 1, wherein the switching element is a PIN diode.

4. The antenna as claimed in claim 1, further comprising: a switching controller for applying a certain prescribed or higher voltage to the switching element to be turned on.

5. The antenna as claimed in claim 1, wherein, upon turning on the switching element, the radiator operates in a lower frequency band than upon turning off the switching element, and upon turning off the switching element, the radiator operates in a higher frequency band than upon turning on the switching element.

6. The antenna as claimed in claim 1, wherein a plurality of the switching elements are positioned, at a predetermined distance, along the direction of the length of the radiator.

7. The antenna as claimed in claim 1, wherein the voltage controlling element is a varactor diode.

8. The antenna as claimed in claim 1, further comprising: a reverse voltage adjuster for supplying a reverse voltage to the voltage controlling element.

9. The antenna as claimed in claim 1, wherein the operation frequency is controlled within a predetermined frequency bandwidth, according to the extent of the reverse voltage applied to the voltage controlling element.

10. The antenna as claimed in claim 1, wherein the operation frequency increases within the predetermined frequency bandwidth as the extent of the reverse voltage applied to the voltage controlling element increases.

11. The antenna as claimed in claim 1, wherein, according to the extent of the reverse voltage applied to the voltage controlling element, upon turning on the switching element, the operation frequency is controlled within a predetermined frequency bandwidth included in a lower frequency band than upon turning off the switching element, and upon turning off the switching element, the operation frequency is controlled within a predetermined frequency bandwidth included in a higher frequency band upon than turning on the switching element.

* * * * *